US006546349B1

(12) United States Patent
Tarr et al.

(10) Patent No.: US 6,546,349 B1
(45) Date of Patent: Apr. 8, 2003

(54) OPTIMAL DEGAUSSING USING AN EVOLUTION PROGRAM

(75) Inventors: Paulo Bertell Tarr, Silver Spring, MD (US); Nevin D. Powell, Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 162 days.

(21) Appl. No.: 09/721,998

(22) Filed: Nov. 27, 2000

(51) Int. Cl.[7] ..... G01R 35/00

(52) U.S. Cl. ..... 702/107; 702/34; 702/38; 702/104; 700/28; 700/32; 700/33; 324/200; 324/207.11; 324/207.12

(58) Field of Search ..... 335/3, 7, 6, 16, 335/15, 21, 38, 42, 99, 103, 147, 148, 149, 177–179, 209, 215, 219, 243, 244, 246, 268, 296, 301, 304; 324/200, 202, 205, 207.11, 207.12, 300; 361/139, 149; 702/107, 85–89, 57, 64–66, 69, 189, 108, 124, 126, 183, FOR 103–106, 110, 111, 134, 156, 170, 171; 700/28, 29, 30–34, 37–40, 44–45, 51, 52, 54, 56, 71, 72, 83–84; 114/FOR 102

(56) References Cited

U.S. PATENT DOCUMENTS 5,463,523 A * 10/1995 Holmes et al. ..... 361/149
6,006,604 A 12/1999 Rabelo et al.

OTHER PUBLICATIONS

Wakao et al., A Novel Design Approach for Grasping Broad Characterstics of Magnetic Shield Problem, Jul. 1998, IEEE, vol. 34, No. 4, pp. 2144–2146.*

Thomas Bäck and Hans–Paul Schwefel, "An Overview of Evolutionary Algorithms for Parameter Optimization," *Evolutionary Computation*, vol. 1, No. 1, 1993, pp 1–23.

David B. Fogel, "An Introduction to Simulated Evolutionary Optimization," *IEEE Transactions on Neural Networks*, vol. 5, No. 1, Jan. 1994, pp 3–14.

(List continued on next page.)

*Primary Examiner*—Marc S. Hoff
*Assistant Examiner*—Elisa Desta
(74) *Attorney, Agent, or Firm*—Howard Kaiser

(57) ABSTRACT

An evolutionary program is used to calibrate a ship degaussing system with respect to one or more parameters relating to the ship's magnetic signature. Pursuant to the computer program, a mathematical vector lists electrical current values which correlate with the degaussing coils. A genetic algorithm is executed through a certain number of generational iterations in order to find a solution vector which will optimize the parameter(s). Every generational population has the same number of vectors. An initial population is randomly engendered, and successive populations are engendered through a biasedly random process wherein each vector has associated therewith a parenthood selection probability which is commensurate with its fitness. The offspring vectors are given birth to via crossover hybridization of parent vectors, and a small fraction of offspring vectors are randomly modified via mutation. The present invention is suitable for accomplishing optimization (e.g., minimization) of practically any parameter bearing relation to an entity's magnetic signature—i.e., not only of the magnetic signature itself but also of a variety of properties related thereto or derivative thereof. Depending on the inventive embodiment, a given genetic algorithmic program is capable of optimizing any number of diverse electromagnetic characteristics of any entity with respect to which a system of coils is being implemented.

29 Claims, 10 Drawing Sheets

OTHER PUBLICATIONS

William M. Spears, Kenneth A. De Jong, Thomas Bäck, David B. Fogel, Hugo de Garis, "An Overview of Evolutionary Computation," *ECML '93*, Proceedings of the European Conference on Machine Learning, Vienna, Austria, Apr. 5–7, 1993, pp 442–459.

Peter Wayner, "Genetic Algorithms: Programming Takes a Valuable Tip from Nature," *BYTE*, Jan. 1991, pp 361–368.

J.H. Holland, "Genetic Algorithms," *Scientific American*, vol. 267, No. 1, 1992, pp 66–72.

David E. Goldberg, "Genetic and Evolutionary Algorithms Come of Age," *Communications of the ACM*, vol. 37, No. 3, 1994, pp 113–119.

David E. Goldberg, *Genetic Algorithms in Search, Optimization and Machine Learning*, Addison Wesley Longman, Inc., New York, 1988, Chapters 1–2 (pp 1–57).

Melanie Mitchell, *An Introduction to Genetic Algorithms*, MIT Press, Cambridge, Massachusetts, 1988, Chapter 1 (pp 1–33), Chapter 5 (pp 155–179).

Zbigniew Michalewicz, *Genetic Algorithms+Data Structures=Evolution Programs*, Second, Extended Edition, Springer–Verlag, New York, 1994, Chapters 1–3 (pp 13–53), Chapters 5–6 (pp 95–118).

* cited by examiner

OPTIMAL DEGAUSSING USING AN EVOLUTION PROGRAM

STATEMENT OF GOVERNMENT INTEREST

The invention described herein may be manufactured and used by or for the Government of the United States of America for governmental purposes without the payment of any royalties thereon or therefor.

BRIEF DESCRIPTION OF THE COMPUTER PROGRAM LISTING APPENDIX

Incorporated herein by reference is a computer program listing appendix setting forth an inventive embodiment of computer source code. This computer program listing appendix is contained as a text document which was created on Jan. 8, 2003 in a CD-R compact disc which is now situated in the application file. The CD-R compact disc contains one data file, 41 KB, in ASCII file format, entitled "uspto09721998computerprogramlistingappendix."

BACKGROUND OF THE INVENTION

The present invention relates to reduction of the magnetic field of an object, more particularly to calibration pertaining to degaussing, and to methods and apparatuses for achieving same.

U.S. Naval combatants are equipped with systems of degaussing coils, the purpose of which is to compensate the magnetic field of the ship, thereby reducing the vessel's vulnerability to a mine threat. In order to perform effectively, it is necessary that a ship's degaussing coil system be calibrated.

The method currently used to calibrate a ship's degaussing coil system includes adjusting the electrical current flowing in each coil, and the number of turns in each coil, until the ship's peak vertical magnetic field, or signature, located at a beam's depth under the keel, has been reduced to a specified limit. This is accomplished by ranging the ship (e.g., at a "Magnetic Silencing Facility") to determine it's existing magnetic field, consulting a handbook of coil effects and selecting the coil or coils which produce a magnetic peak nearest the peak in the ship's existing magnetic field, and adjusting the current and turns in that coil or coils to compensate for and reduce the peak in the ship's field. However, this method is limited to adjusting one or a few coils at a time, and becomes more difficult to implement as the number of coils in a degaussing system increases.

Another method for calibrating systems of degaussing coils has been used in the research model laboratory for over twenty years. This method includes performing a least-mean-squared-error (LMSE) fit of all of the model degaussing coil effects to the model ship's magnetic signature, using a computer. This method enables better magnetic signature reduction, as the impact of all coils in the system can be calculated and utilized at once. This computer-assisted "wholistic" approach has been used in the field recently and has met with success in reducing ship magnetic signatures to levels below that which is capable using the manual "coil-by-coil" approach described hereinabove. However, this method is limited to minimizing the average squared error between the ship signature (or signals derived from the ship signature) and a linear combination of the coil effects (or signals derived from the coil effects); it cannot be used, for example, to minimize the peak residual magnetic field signature.

Accordingly, there is a need for a degaussing coil methodology which can be efficiently implemented for practically any number of coils, and which is capable of achieving minimization of any signal derived from the degaussed signature—not merely minimization of the mean squared error between the undegaussed signature and the coil effects.

SUMMARY OF THE INVENTION

In view of the foregoing, it is an object of the present invention to provide method and apparatus for calibrating a system of degaussing coils located around or inside an entity (such as a ship), in order to reduce the magnetic field of the entity.

It is a further object of the present invention to provide such method and apparatus which admits of practical application with respect to large as well as small numbers of degaussing coils.

It is another object of the present invention to provide such method and apparatus which can be implemented so as minimize virtually any signal derived from the degaussed signature.

In accordance with the present invention, a method is provided for calibrating a degaussing system for application to an object having a magnetic field associated therewith. The degaussing system is of the kind including at least one coil (more typically, plural coils) for conducting electrical current and for being proximately (e.g., peripherally) disposed in relation to said object. The inventive method comprises: designating at least one optimization parameter pertaining to the magnetic signature of the object in a degaussed condition; defining a current vector (e.g., mathematical array) containing at least one current value wherein each coil corresponds to a (at least one, but typically one) current value; and, executing a genetic algorithm so as to identify a solution of the current vector wherein the application of at least one current value to (at least one coil in) the degaussing system tends to optimize at least one optimization parameter.

Further provided in accordance with the present invention is a computer program product which comprises a computer useable medium having computer program logic recorded thereon for enabling a computer to calibrate a degaussing system for application to an object having a magnetic field associated therewith. The degaussing system is of the type which includes at least one coil for conducting electrical current and for being proximately disposed in relation to the object. The computer program logic comprises: means for enabling the computer to designate at least one optimization parameter pertaining to the magnetic signature of the object in a degaussed condition; means for enabling the computer to define a current vector containing at least one current value wherein each coil corresponds to a current value; and, means for enabling the computer to execute a genetic algorithm so as to identify a solution of the current vector wherein the application of at least one current value to the degaussing system tends to optimize at least one optimization parameter.

Also provided according to the present invention is a machine having a memory, such as a computer (e.g., that which includes a processor). The machine contains a data representation of the calibration of a degaussing system for application to an object having a magnetic field associated therewith. The degaussing system is of the type which includes at least one coil for conducting electrical current and for being proximately disposed in relation to the object. The data representation is generated, for availability for containment by the machine, by the method comprising: designating at least one optimization parameter pertaining to the magnetic signature of the object in a degaussed condition; defining a current vector containing at least one current value wherein each coil corresponds to a current value; and, executing a genetic algorithm so as to identify a solution of the current vector wherein the application of at least one current value to the degaussing system tends to optimize at least one optimization parameter.

Further provided in accordance with the present invention is a method for degaussing an object having a magnetic field associated therewith. The inventive method comprises: proximately disposing at least one coil in relation to the object; calibrating at least one coil; and, causing at least one coil to conduct electrical current in accordance with the calibrating. The calibrating includes: designating at least one optimization parameter pertaining to the magnetic signature of the object in a degaussed condition; defining a current vector containing at least one current value wherein each coil corresponds to a current value; and, executing a genetic algorithm so as to identify a solution of the current vector wherein the effectuation of at least one current value tends to optimize at least one optimization parameter.

Also provided according to the present invention is a system for degaussing an object having a magnetic field associated therewith. The inventive system comprises: at least one coil for conducting electrical current and for being proximately disposed in relation to the object; means for calibrating at least one coil; and, means for causing at least one coil to conduct electrical current in accordance with the calibrating. The calibrating includes: designating at least one optimization parameter pertaining to the magnetic signature of the object in a degaussed condition; defining a current vector containing at least one current value wherein each coil corresponds to a current value; and, executing a genetic algorithm so as to identify a solution of the current vector wherein the effectuation of at least one current value tends to optimize at least one optimization parameter.

The present invention represents a unique methodology for calibrating a degaussing coil system, and hence for practicing degaussing using a coil system which has been inventively calibrated. Notably featured by the present invention is the effectuation of a genetic algorithm for solving a mathematical vector (e.g., array) of electrical current values, wherein the solution objective is the optimization of one or more properties related to the degaussing of an object's (e.g., a ship's) magnetic signature. Generally according to preferred inventive practice, the subject degaussing coil system will include at least two coils. In the majority of inventive embodiments, the current vector will include plural current values which are in one-to-one correspondence with the plural coils. However, some inventive embodiments will involve a current vector in which certain (e.g., one, some or all) coils correspond to plural current values, or in which certain (e.g., one, some or all) current values correspond to plural coils.

An "evolutionary algorithm" is a computer-based problem-solving system which, in terms of design and implementation, is characterized by one or more computational models of one or more evolutionary processes. A particular genre of evolutionary algorithm is a "genetic algorithm," which represents a metaphor for the evolutionary and genetic processes in nature, commonly identified with Charles Darwin and Gregor Mendel. A genetic algorithm involves an iterative procedure which simulates, imitates or mimicks the genetic principles of Mendelian heredity along with the "survival-of-the-fittest" principles of Darwinian evolution of species. A genetic algorithm does not yield a random result, albeit it involves indicia of randomness; rather, it can "evolve" a better-than-random, optimum-approaching solution to a problem.

The cyber-world (artificial life) mating of algorithmic chromosomes, pursuant to a genetic algorithm, resembles the real-world (real life) mating of biological chromosomes. A typical genetic algorithm begins with an initial "population" of "chromosomes." This first population of chromosomes, typically formulated in random fashion, can also be described as the first "generation." A population is a set of solutions (chromosomes) to a problem, wherein each chromosome has plural components, or "genes." Each succeeding generation contains chromosomal "offspring" from the preceeding generation, similarly as occurs in the biological evolutionary genetic processes of natural selection and heredity. The final population of chromosomes contains the best solution to the problem; that is, the "fittest" chromosome among all the chromosomes in the last generation constitutes the ultimate or optimal solution.

According to typical genetic algorithms, chromosomes are selected (e.g., in pairs) and are combined with each other in a hybridizing (e.g., crossover) fashion whereby individual chromosomes are partitioned and the offspring chromosomes have combinations of characteristics (genes) from the parent chromosomes. For instance, according to a common genetic algorithmic combinative approach, chromosomes are repeatedly selected in pairs wherein each selected parent chromosomal pair produces an offspring chromosomal pair; that is, on each occasion, two parent chromosomes are selected and are combined (e.g., via a crossover procedure) to form two offspring chromosomes.

In addition, according to typical inventive embodiments, individual chromosomes will mutate on a sometimes (e.g., occasional) basis. Depending on the inventive embodiment, the mutation function can be applied in various ways to any of various pools of chromosomes. For instance, based on a certain (typically, low) probability, a percentage of offspring chromosomes will each be caused to randomly mutate (wherein one or more genes therein undergoes a change). According this kind of common genetic algorithmic mutative approach, a mutation function is applied to offspring chromosomes which have been engendered by selection and combination of parent chromosomes. As another approach, the mutation function can be applied to parent chromosomes prior to selection and combination thereof. Alternatively, the effecting of mutation can be determined in some other manner.

Built into the chromosome selection process is a bias toward more "fit" chromosomes and against less "fit" chromosomes; thus, the probabilities are weighted according to fitness as to which chromosomes of a given population are to become parents to the offspring of the next population. The term "roulette wheel" is conventionally used to describe many such schemes having indicia of both randomness and bias. The weightedness or probability variation can be analogized to a "roulette wheel" having variously sized slots corresponding to variously fit chromosomes. Another anology is a "lottery" methodology in which the respective numbers of ping-pong balls are commensurate with their respective fitnesses.

There are other examples of biasedly randomized arrangements wherein outcomes are basically left to chance, except that probabilities are higher or lower according to corresponding fitnesses. In any event, usually according to the present invention, this fitness-based selection is performed "with replacement"; that is, the same chromosome can be selected more than once to be a parent. In other words, even when a chromosome is selected to be a parent, that selected chromosome remains in the pool of potential parent chromosomes and can be selected again. Therefore, after a roulette wheel is spun and the ball lands in a particular slot, all of the slots of a roulette wheel remain in place, the roulette wheel ready to be re-spun. In the context of the ping-pong ball analogy, after a bin is stirred, any ping-pong ball which is selected from the bin to be a parent will be returned to the bin, and the bin can subsequently be re-stirred.

Thus, according to many conventional genetic algorithms, the creation of each ensuing population entails fitness-based selection, hybridization and mutation with respect to the previous population. Generally, the tendency will be such that as the number of generations increases the population's chromosomal pool will improve insofar as representing solutions to the problem. The evolutionary genetic process encourages the "survival" of the "fittest" solutions; by virtue of the "selective pressure" which favors the fittest, the population keeps improving as a whole. For instance, each succeeding generation will be at least slightly better on average than the preceeding generation, or will contain at least one chromosome which is at least slightly better than every chromosome in a preceeding generation.

An abundance of instructive literature has been published on genetic algorithms and on evolutionary algorithms in general. Incorporated herein by reference are the following two textbooks: David E. Goldberg, *Genetic Algorithms in Search, Optimization and Machine Learning,* Addison Wesley Longman, Inc., New York, 1989; Melanie Mitchell, *An Introduction to Genetic Algorithms,* MIT Press, Cambridge, Mass., 1996. Also incorporated herein by reference are the following six articles: Peter Wayner, "Genetic Algorithms: Programming Takes a Valuable Tip from Nature," *BYTE,* January 1991, pp 361–368; J. H. Holland, "Genetic Algorithms," *Scientific American,* Volume 267, No. 1, 1992, pp 66–72; W. M. Spears et al., "An Overview of Evolutionary Computation," *ECML* '93, Proceedings of the European Conference on Machine Learning, Vienna, Austria, Apr. 5–7, 1993, pp 442–459; Thomas Bäck et al., "An Overview of Evolutionary Algorithms for Parameter Optimization," *Evolutionary Computation,* Vol. 1, No. 1, 1993, pp 1–23; D. B. Fogel, "An Introduction to Simulated Evolutionary Optimization," *IEEE Trans. Neural Networks,* Vol. 5, No. 1, 1994, pp 3–14; David E. Goldberg, "Genetic and Evolutionary Algorithms Come of Age," *Communications of the ACM,* Vol. 37, No. 3, 1994, pp 113–119; Zbigniew, Michalewixz, "Genetic Algorithms+Data Structures= Evolution Programs," Springer-Verlag, New York, 1994.

The present invention uniquely features a genetic algorithm which "evolves" an optimal (optimally tending) solution to the calibration of degaussing coils. According to many embodiments of this invention, the chromosomes are mathematical vectors (mathematical arrays) of electrical current values (genes). The first population of current vectors (chromosomes) is selected randomly. Each ensuing population of current vectors (chromosomes) arises from the previous population via a genetic algorithmic procedure including fitness-based selection of current vectors (chromosomes), combination (e.g., hybridization, as by crossover) of (e.g., pairs of) current vectors (chromosomes), and mutation (e.g., based on a relatively low random probability) of current vectors (chromosomes). The solution to the degaussing coil problem is represented by the current values (genes) contained in the fittest current vector (chromosome) which exists in the final population, i.e., the last generation.

In accordance with the present invention, a solution to the degaussing problem is found which is "optimal." The optimal solution is not that which may be graphically envisioned as the single, maximum point on a curve which rises to the maximum point and falls therefrom. Rather, the optimal solution is that which may be graphically envisioned in the context of a curve which rises and continues to rise, approaching (e.g.,asymptotically in relation to a horizontal line representative of) a limit which constitutes "limitary" optimum, a theoretically approachable but elusive optimum; the optimal solution is a point which tends toward or approaches the limitary optimum. With each ensuing generation, or at least with groups of two or more ensuing generations, the solution takes a step closer to limitary optimum. The "optimal" solution is really a solution which tends to optimize—i.e., which tends toward or approaches the limitary optimal solution. It is nearly or approximately equal to the limitary optimal solution, or at least considerably closer to the limitary optimal solution than to a purely random solution.

Typically according to this invention, each current vector (chromosome) will have the same number of current values (genes), since the current vectors correspond to, and equal in number, the coils in the degaussing system. In his/her inventive design of the computer program, the inventive practitioner will consider the nature of the problem, including the number of current values (genes) in each current vector (chromosome), and will adjudge the appropriate size of the population as well as the appropriate number of generations—such that an optimal (i.e., optimally tending) solution will be obtained. Once the present invention's iterative process has repeated through a certain number of generations, a point will be reached wherein the "fittest" current vector (chromosome) in the population will represent a solution which, to at least a substantial degree or for all intents and purposes, is the limitary optimal solution. The inventive practitioner will generally seek an optimal solution in other words, a solution which tends to optimize degaussing, with respect to one or more selected optimization parameters, of the object being degaussed.

The inventive practitioner will preferably repeat the generational iterations a sufficient number of times so that this point of substantial or practical equivalence to the limitary optimum is reached. There are various approaches to mathematically incorporating such decision regarding number of generations into the inventive program. One approach is to establish a fixed number of generations in the program. This approach is feasible provided the inventive practitioner can be confident that implementation of this fixed number, in inventive application, will result in an optimal solution. Another approach to achieving an optimal solution is to establish the last generation (i.e., cessation of the inventive genetic evolution) to be that which fails to significantly differ from the preceeding generation in terms of fitness. Otherwise expressed, a propitious time to cease creating new generations is when a "point of diminishing return" has been reached insofar as improving fitness; that is, a point has been reached wherein the difference in fitness from one generation to the next is minimal, negligible or virtually nonexistent.

This generation-to-generation fitness differential can be ascertained in various ways. For instance, the average of the respective fitness values of the current vectors (chromosomes) a preceeding population can be compared with the average of the respective fitness values of the current vectors (chromosomes) of a succeeding population; in effect, the "average" fitness (e.g., arithmetic mean, median or mode) would constitute a measurement characterizing the overall fitness of a particular population. Or, as another example, along similar lines, the greatest (maximum) fitness value of a current vector (chromosome) of a preceeding population can be compared with the greatest (maximum) fitness value of a current vector (chromosome) of a succeeding population. When a stage has been reached wherein the fitness differential between consecutive generations is minimal, negligible or approximately nil, the inventive program's iterative process can be stopped with the reasonable assurance that the solution thereby obtained (from among the set of current vectors in the final population) is about as good a solution as can be obtained.

The present invention represents a new approach to the calibration of combatant degaussing systems. This invention uses an evolution program to optimize various parameters of the degaussed magnetic signature. Typical embodiments of the inventive program incorporate a floating point genetic algorithm with arithmetic combination operators and a non-uniform mutation operator. Various fitness functions can be explored in accordance with the present invention, including but not limited to the following functions which are discussed herein: (i) optimization of root mean square (RMS); (ii) peak; (iii) peak rate of change (ROC); (iv) peak rate of change (ROC) in a signature segment; and, (v) distance of the degaussed signature from a desired goal signature. The present invention is applicable not only to ship degaussing coil systems but also to a variety of other (non-ship) degaussing coil systems.

The optimal degaussing (abbreviated "ODG" or "OD") evolution program and method in accordance with the present invention has several advantages over previous degaussing methodologies. A propitious flexibility is afforded by the present invention in terms of what is being optimized; the inventive program and method can be adapted toward achieving one, two or several modes—indeed, practically any number of modes—of "optimality." The present invention is not limited to minimizing the mean squared error between the undegaussed signature and the coil effects, but can be used to minimize any arbitrary criterion/criteria based on the residual signature obtained after combining the coil effects with the undegaussed signature. In accordance with the present invention, any signal derived from the degaussed signature can be minimized. For example, the degaussed signature can be applied to a certain type of mine, and the output of the mine can be used as the minimization criterion. Also, according to this invention, any combination of criteria can be used. For example, the mine sensor output can be minimized at the same time that the overall power consumption of the coil system is minimized.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

BRIEF DESCRIPTION OF THE APPENDICES

The following appendices are hereby made a part of this disclosure:

Attached hereto marked APPENDIX A and incorporated herein by reference are twenty-seven sheets containing an inventive embodiment of computer source code.

DETAILED DESCRIPTION OF THE INVENTION

Figure 1:
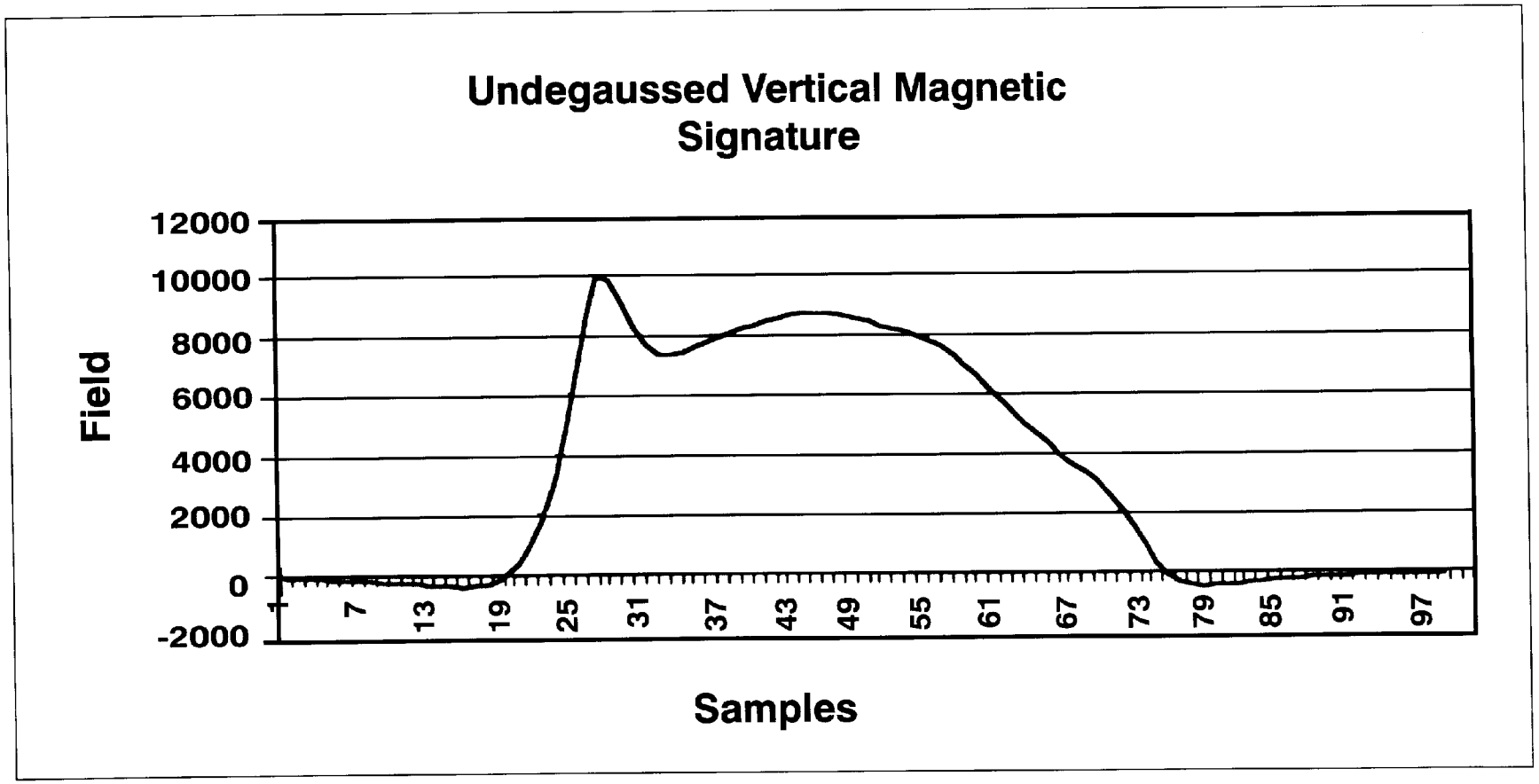
FIG. 1 is a graphical representation of a vertical magnetic signature of a typical undegaussed U.S. Navy ship.
Figure 2:
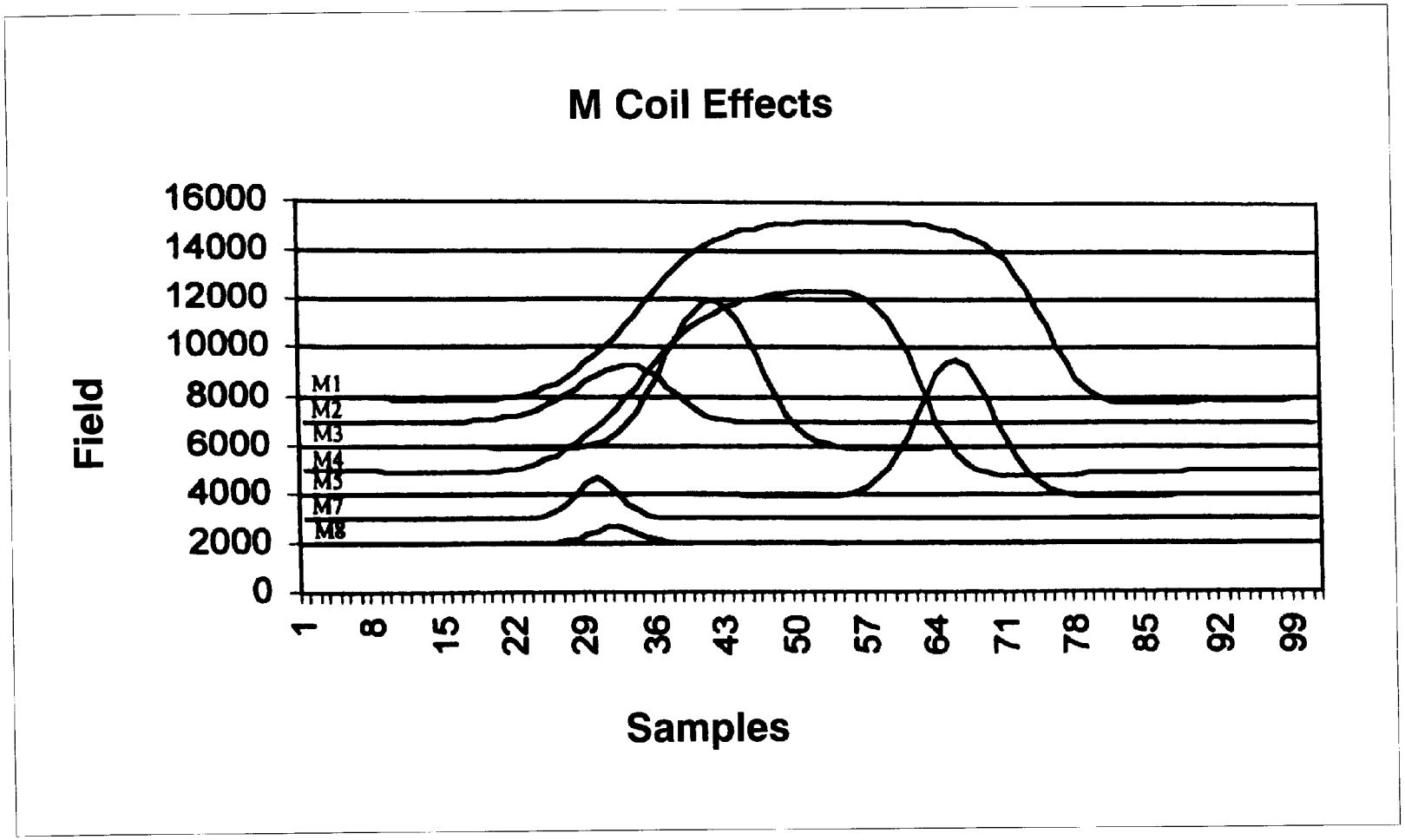
FIG. 2 is a graphical representation of the coil effects of a degaussing system applied to a U.S. Navy ship such as depicted in FIG. 1.

In accordance with many embodiments of the present invention, the ship magnetic signature and coil effects are first measured or modeled. Referring now to FIG. 1 and FIG. 2, mathematical models of the ship's keel-line magnetic signature and M-coil effects are used herein for describing typical operation of the present invention. The undegaussed keel-line magnetic signature at a depth of 67 feet is shown in FIG. 1. The ship is centered in the plot, with bow to the left. The signature was sampled every 10 feet. Modeled effects of the M coils at the same depth and sampling are shown in FIG. 2. The effects are offset from each other by 1000 nT, for clarity, and each effect was produced with 1000 amps. The magnetic effect(s) of the coil(s) are also referred to herein as the "magnetic effectuation" of the coil(s).

Figure 3:
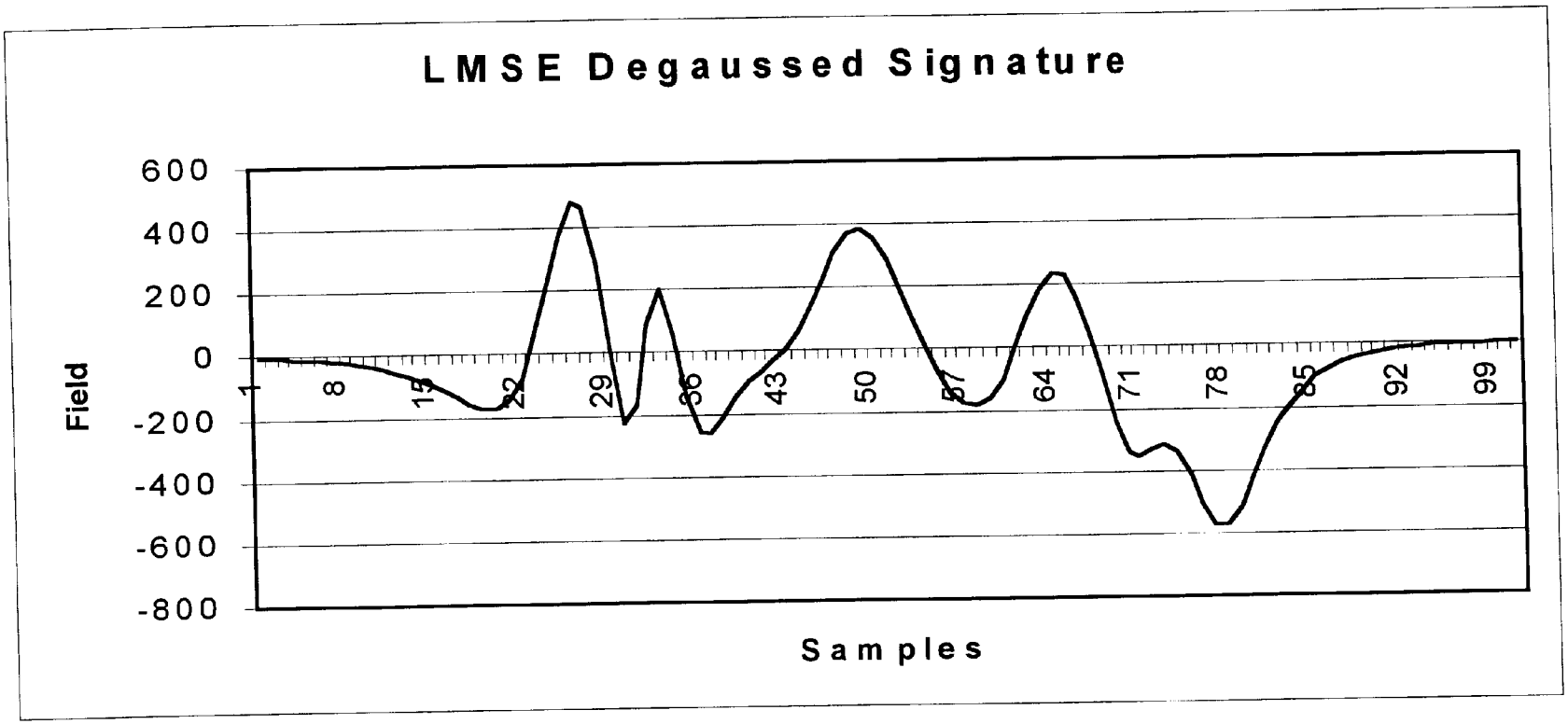
FIG. 3 is a graphical representation of a degaussed signature of a U.S. Navy ship such as depicted in FIG. 1, wherein the signature is degaussed using a conventional least-mean-squared-error (LMSE) fitting technique.

With reference to FIG. 3, a least-mean-squared-error (LMSE) fit of the model degaussing coil effects shown in FIG. 2 to the model ship's magnetic signature shown in FIG. 1 can be performed (e.g., using a processor). The degaussed signature formed as a result of calibrating this set of coils with a constrained least-mean-squared-error algorithm is shown in FIG. 3. The general current vector for a degaussing solution with this coil system is {c1, c2, c3, c4, c5, c6, c7}, and in this case, c1=713 amps; c2=1107 amps; c3=134 amps; c4=438 amps, c5=−51 amps, c6=3990 amps; and c7=−433 amps. The RMS value of the degaussed signature is 215 nT.

Figure 4:
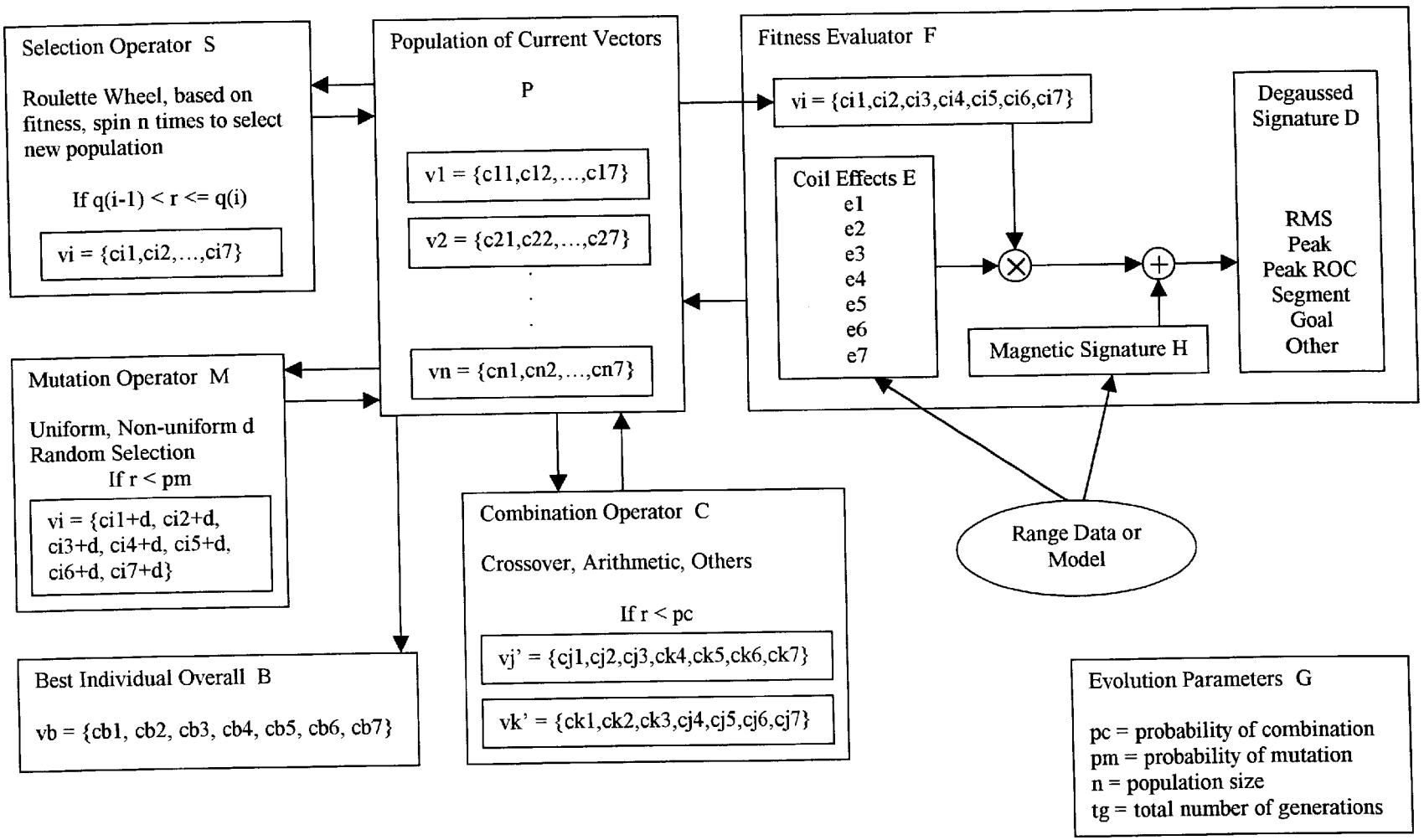
FIG. 4 is a block diagram of an embodiment of an optimal degaussing evolution program and method in accordance with the present invention.

Reference is now made to FIG. 4. A block diagram of typical embodiments of the inventive evolution program and method for optimal degaussing is shown in FIG. 4. The magnetic signature H and coil effects E are measured at a magnetic silencing facility or computed with suitable computer models. The degaussed Signature D is produced by combining coil effects scaled by a current vector vi={ci1, ci2, ci3, ci4, ci5, ci6, ci7}, with the magnetic signature H. The fitness of vi is determined by the desired degaussed signature optimization parameter: root mean square (RMS), peak, peak rate-of-change, peak rate-of-change in a segment of the signature, distance of the signature from a desired goal signature, or any other optimization parameter that can be derived, linearly or non-linearly, from the degaussed signature. A population of n current vectors P is operated on by a Fitness Evaluator F, a Selection Operator S, a Combination Operator C, and a Mutation Operator M. The evolution parameters G determine population size, probability of combination, probability of mutation, and total number of generations.

The population is initialized by generating constrained random currents for each vector. A random number r(j) is generated in the range [cmin(j) . . . cmax(j)], for the jth current in each vector, where cmin(j) is the minimum allowable current for coil j, and cmax(j) is the maximum allowable current for coil j. The Selection Operator produces a new population P(t+1) of current vectors by selecting randomly from the existing population P(t) of current vectors. The selection process is based on a roulette wheel with slots sized according to fitness; the current vectors are characterized by corresponding probabilities of being selected which are commensurate with the corresponding degrees of fitness. Selection is effectuated "with replacement." First, the fitness value fval(vi) is computed for each member of the population P, using the Fitness Evaluator F. The individual current vector with the best fitness is stored as the Best Individual Overall B. Then the total fitness, FT, of the population is computed by summing the fitness of each member of the population. The probability of selection pi for each member vi (i=1, . . . , n) is calculated as pi=fval(vi)/FT. The cumulative probability qi for each member vi (i=1, . . . , n) is then calculated as qi=sum(j=1,i)pj. Selection is made by generating a random number r from the range [0 . . . 1] and selecting the ith member vi (1<I<n) such that q(i−1)<r<=q(i). The selection process is repeated n times to produce P(t+1).

Following selection, the combination operator C is applied to pairs of individuals in the new population P. For each member of the new population, a random number r is generated in the range [0 . . . 1]. If r is less than the probability of combination, pc, that individual is chosen for combination with the next individual selected in this manner. Each pair of individuals is then combined using the combination operator C. For each pair to be combined, a random number r is generated in the range [1 . . . m], where m is the number of coils (in this case m=7). Combination of the m−r currents in the two individual current vectors produces two new current vectors, which replace the original pair of vectors in the population. The first new vector is produced by switching the tails of the vectors be combined as follows. If r=4 and v1={c11, c12, c13, c14, c15, c16, c17} and v2={c21, c22, c23, c24, c25, c26, c27}, then v1'={c11, c12, c13, c14, c25, c26, c27}. The second new vector is produced by adding the tails of the vectors to produce v2'={c11, c12, c13, c14, c15+c25, c16+c26, c17+c27}. Each current in this vector is then clipped to ensure that all currents are allowable values. In accordance with this invention, other combination methods are also possible.

Following the combination process, the mutation operator M is applied to the population P. For each member of the population, a random number r is generated in the range [0. . . 1]. If r is less than the probability of mutation, pm, then the current vector under consideration is changed as follows. A mutation range is computed: mr=1−r^(1−ng/tg)^2, where r is a random number in the range [0 . . . 1], ng is the generation number of the population, and tg is the total number of generations, or iterations of this evolution process. A mutation value is then computed for each coil current in the vector: mv(j)=mr*(cmax(j)−cmin(j)) where cmax(j) is the maximum allowable current for coil j, and cmin(j) is the minimum allowable current for coil j. A random number r(j) in the range [−mv(j) . . . mv(j)] is then added to the jth current value in the vector. So if we select a vector from the population, vi={ci1, ci2, ci3, ci4, ci5, ci6, ci7}, and apply the mutation operator M, the resulting vector is vi'={ci1+mv(1), ci2+mv(2), ci3+mv(3), ci4+mv(4), ci5+mv(5), ci6+mv(6), ci7+mv(7)}. Each current in this vector is then clipped to ensure that all currents are allowable values.

The present invention's optimal degaussing evolution program finds a solution by repeating certain above-described operations—viz., selection of a new population based on fitness, combination of selected individuals, and mutation of selected individuals—until the total number of generations, tg, has elapsed. The Best Individual Overall, B, is then the optimal degaussing solution, based on the degaussing parameter being optimized.

Figure 5:
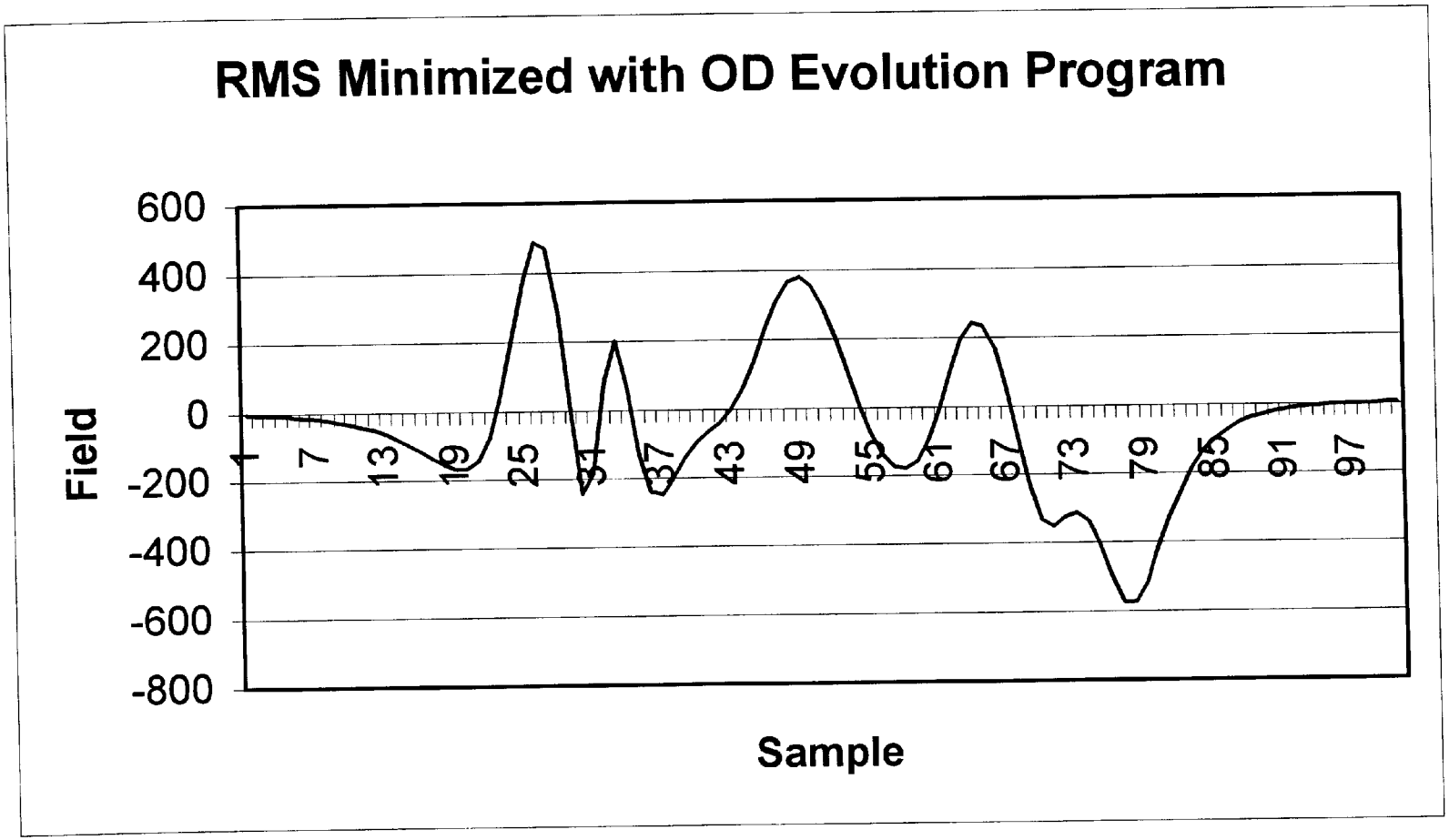
FIG. 5 is a graphical representation of a degaussed signature of a U.S. Navy ship such as depicted in FIG. 1, wherein the signature is degaussed so as to minimize the root mean square (RMS) using an inventive optimal degaussing evolution program.

Reference is now made to FIG. 5 through FIG. 9, which illustrate results obtained by effectuating inventive techniques involving computer modeling and analysis. FIG. 5 shows the degaussed signature when the present invention's optimal degaussing evolution program is used to minimize the RMS value of the degaussed signature. The population size was 50, probability of combination was 0.5, probability of mutation was −0.1, and the total number of generations was 10,000. The best individual overall solution was vb={713, 1093, 135, 438, −52, 4000, −382}. This solution is very close to that obtained above using the constrained least-mean-squared-error (LMSE) algorithm, and the RMS value of the optimizer-degaussed signature has the same value of 215 nT.

Figure 6:
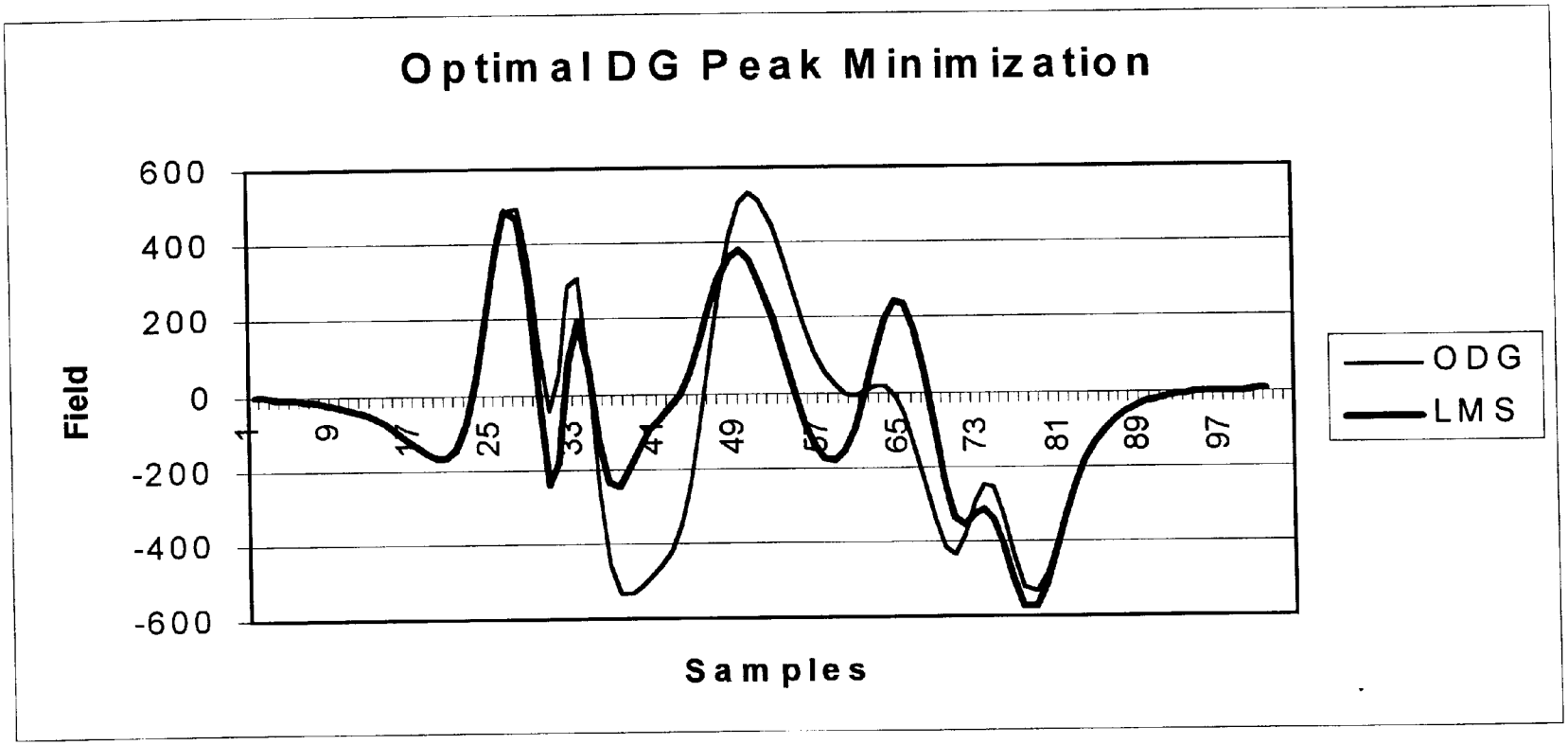
FIG. 6 is a comparative graphical representation of a degaussed signature of a U.S. Navy ship such as depicted in FIG. 1. As shown by curve "ODG," the signature is degaussed so as to minimize the peak of the degaussed field (DG peak) using an inventive optimal degaussing evolution program. As comparatively shown by curve "LMS," the signature is alternatively degaussed so as to minimize the peak of the degaussed field (DG peak) using a conventional least-mean-squared-error (LMSE) fitting technique.

The present invention's optimal degaussing evolution program was used to minimize the peak field of the degaussed signature. This inventively degaussed signature result is shown in FIG. 6, labeled "ODG", and is compared to the LMSE degaussed signature, labeled "LMS." The ODG peak field is −535 nT and the LMSE peak field is −573 nT. The present invention thus advantageously affords a reduction of 38 nT, or 7%. Generally, the degree of peak reduction will depend heavily on how well the coil effects span the undegaussed signature space. Using more coils, properly placed, will yield a better fit and lower peak field value.

Figure 7:
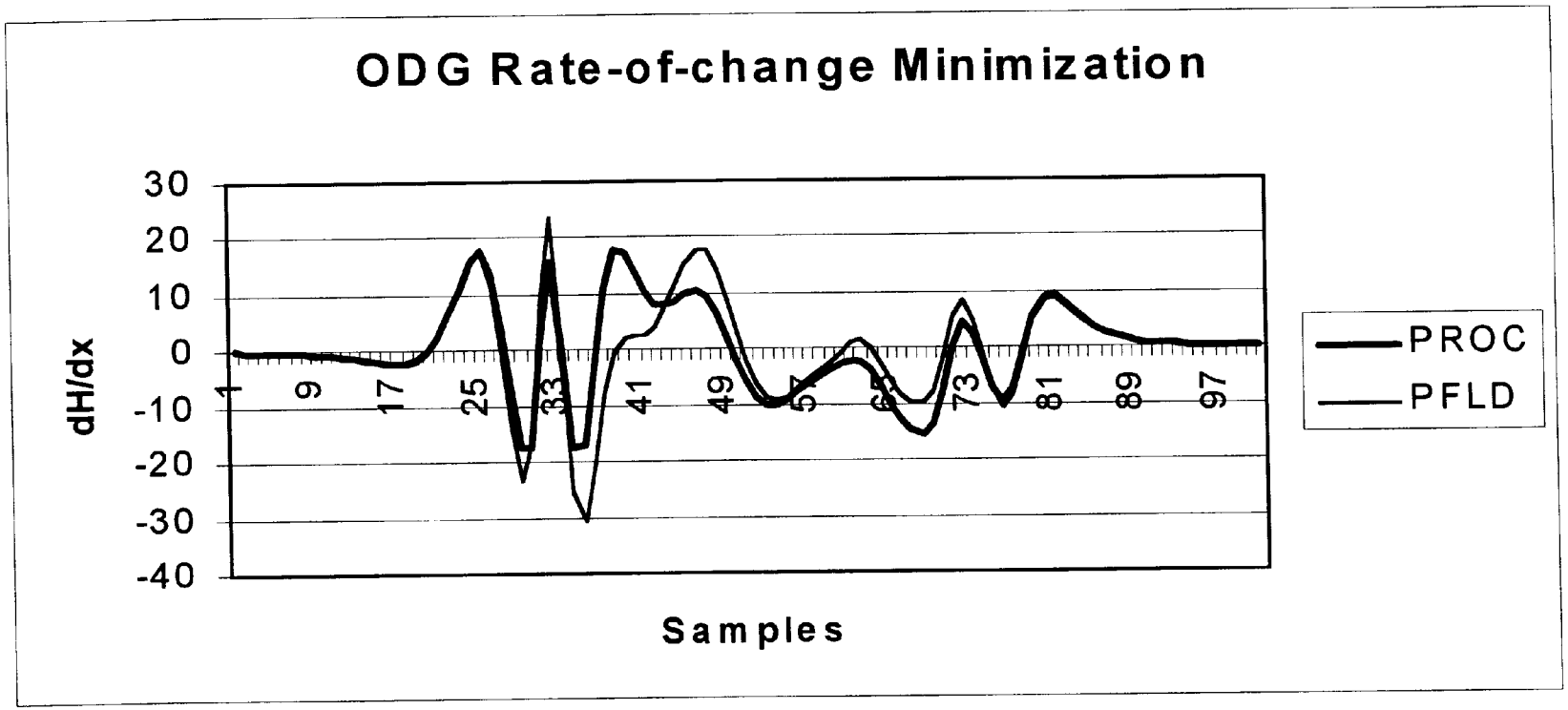
FIG. 7 is a comparative graphical representation of rate-of-change of a degaussed signature of a U.S. Navy ship such as depicted in FIG. 1. As shown by curve "PROC," the rate-of-change (dH/dx) is plotted for the signature, degaussed so as to minimize the peak rate-of-change in the degaussed signature using an inventive optimal degaussing evolution program. As comparatively shown by curve "PFLD," the rate-of-change (dH/dx) is plotted for the signature, alternatively degaussed so as to minimize the peak of the degaussed field (DG peak) using an inventive optimal degaussing (OD) evolution program.

The results of minimizing the peak rate-of-change in the degaussed signature are shown in FIG. 7. When peak field is minimized using the present invention's optimal degaussing program, the peak-rate-of-change in the degaussed signature is −31 nT/ft. Using the present invention's optimal degaussing program to minimize the peak rate-of-change results in a value of 18 nT/ft, thus advantageously affording a reduction of 13 nT/ft, or 42%. Accordingly, if an objective is to minimize peak rate-of-change, it is generally preferable to practice the present invention so as to directly minimize peak-rate-of-change, rather than adopt the strategy of indirectly affecting peak-rate-of-change by directly minimizing peak field (whether practicing the present invention or some non-inventive technique).

Figure 8:
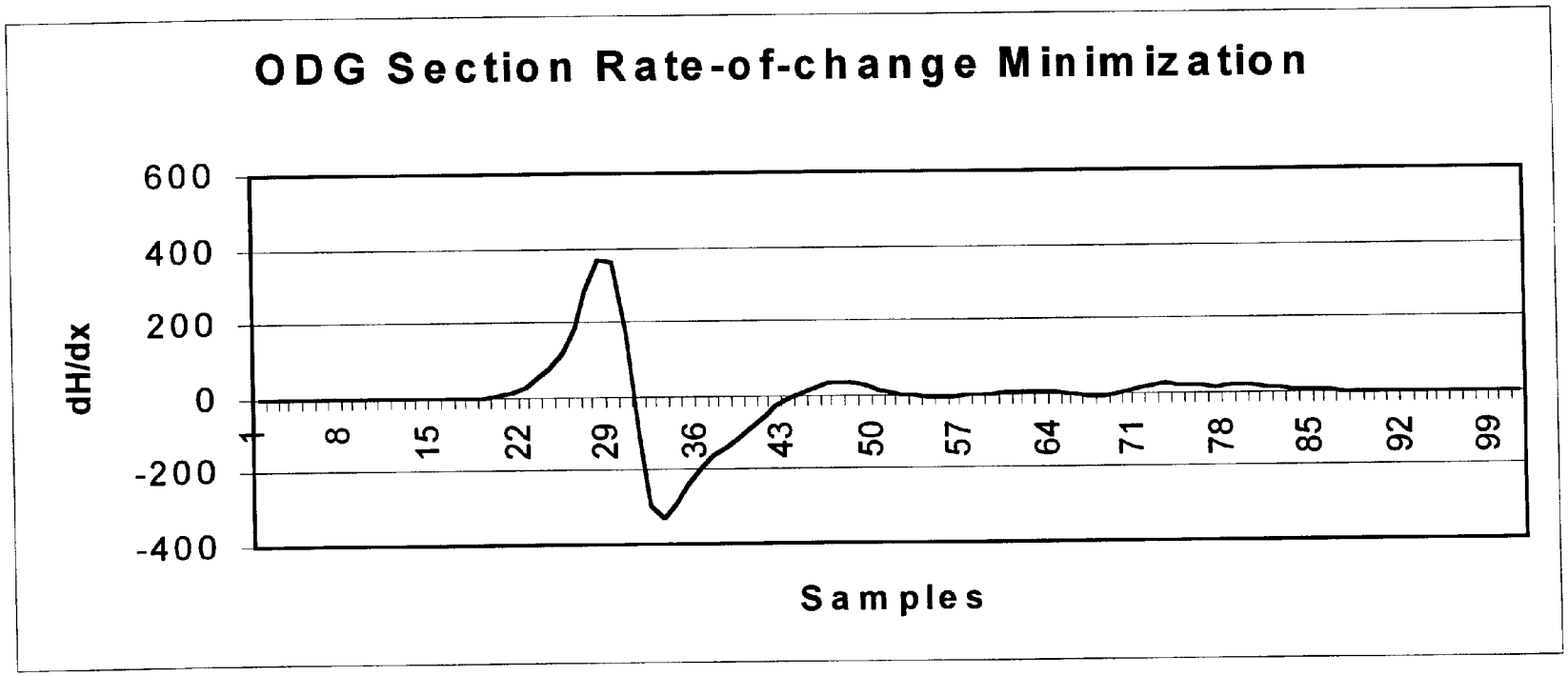
FIG. 8 is a graphical representation of rate-of-change of a degaussed signature of a U.S. Navy ship such as depicted in FIG. 1, wherein the signature is degaussed so as to minimize the peak rate-of-change in a portion of the degaussed signature (PROC) using an inventive optimal degaussing (OD) evolution program.

Minimizing the peak rate-of-change over a section of the degaussed signature results in the waveform shown in FIG. 8. The present invention's optimal degaussing evolution program was used to minimize this parameter over samples 51 to 70. The peak rate-of-change in this section of the degaussed signature is 6 nT/ft.

Figure 9:
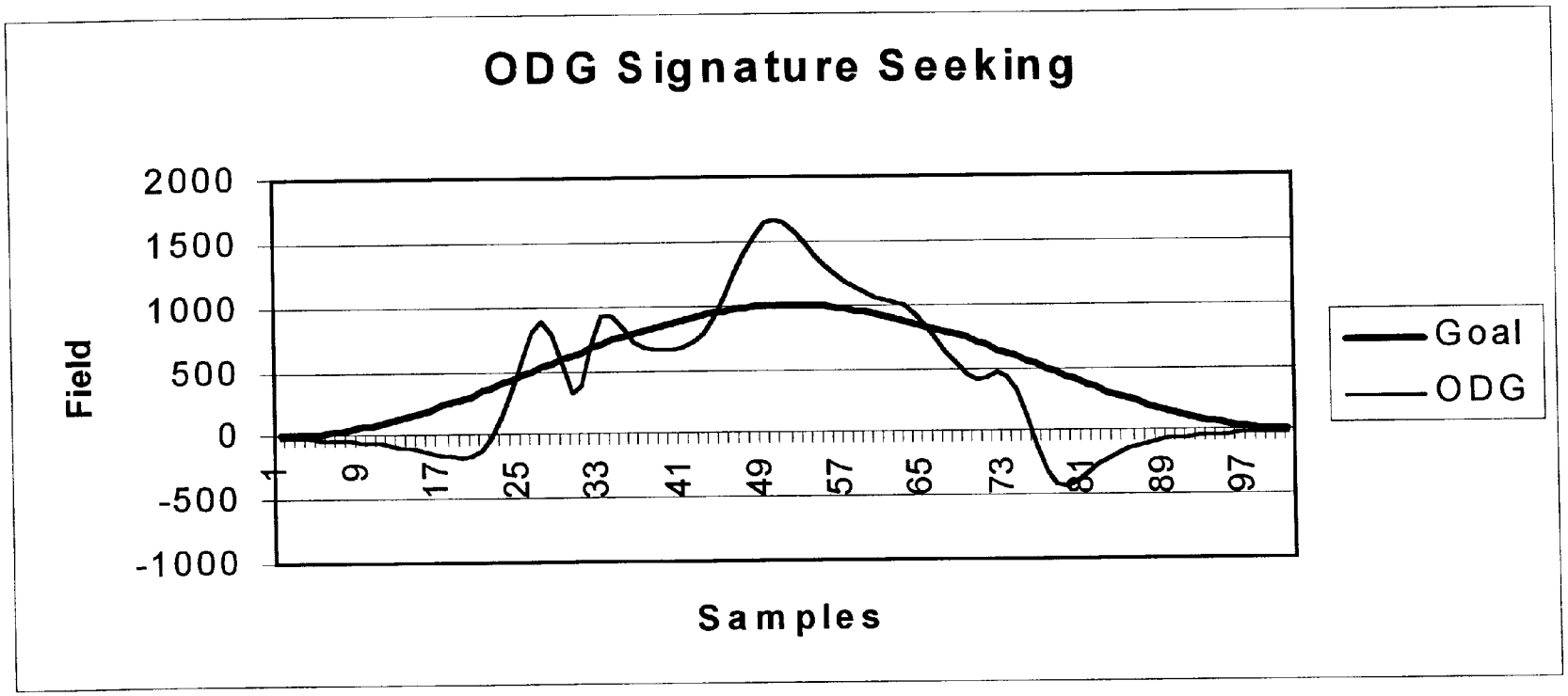
FIG. 9 is a graphical representation of a degaussed signature of a U.S. Navy ship such as depicted in FIG. 1, wherein the signature is degaussed so as to "match" (i.e., minimize the difference between the degaussed signature and) a raised cosine curve.

The present invention's optimal degaussing evolution program can also be used to find degaussed signatures that match some desired goal signature. The results of using a raised cosine goal signature are shown in FIG. 9. The RMS value of the difference between the degaussed signature and the goal signature, as well as the peak value of the difference, was minimized. Here again, generally, a coil set which better spans the undegaussed signature space will yield a better matching signature.

Figure 10:
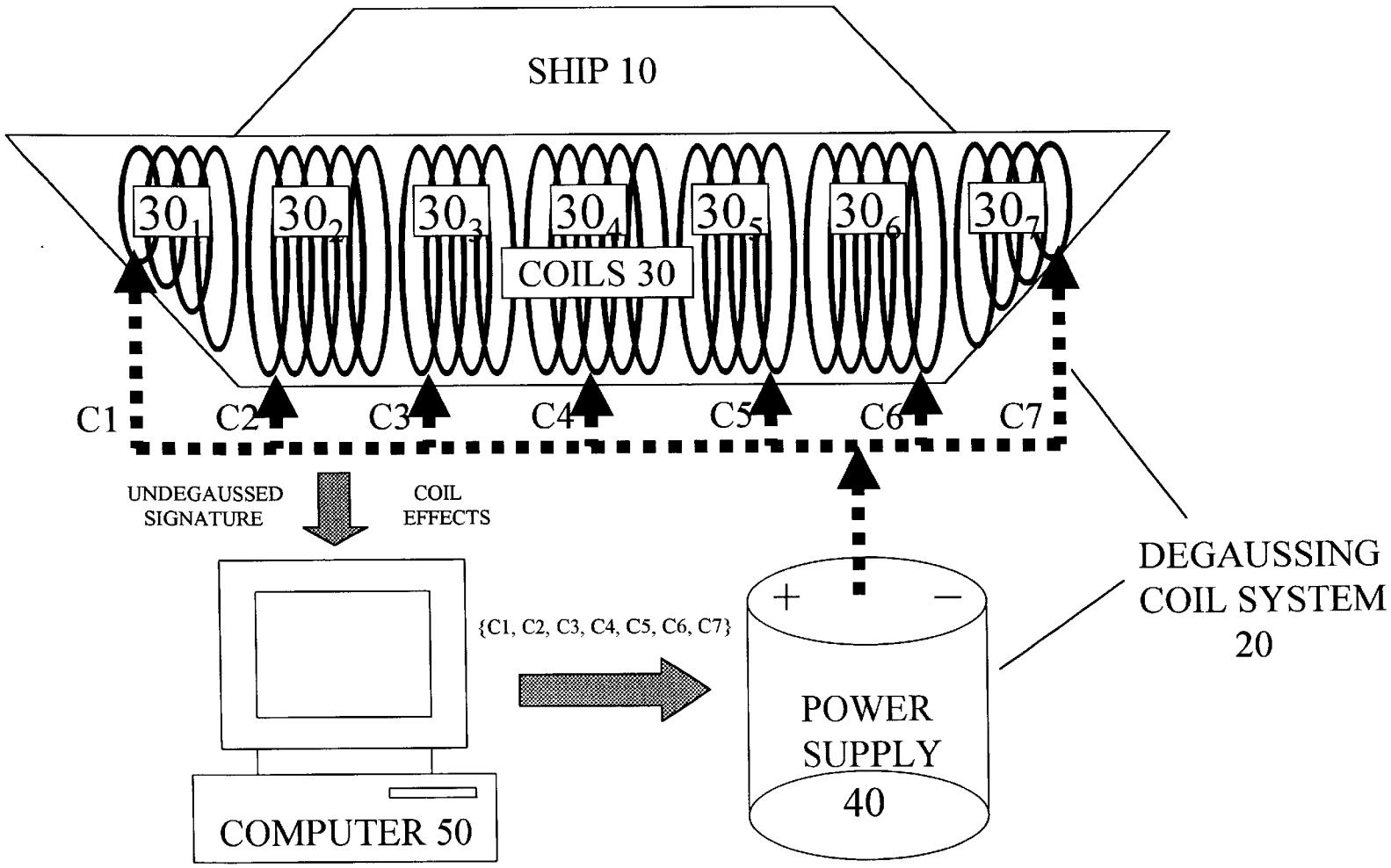
FIG. 10 is a block diagram of an embodiment of optimal degaussing practice in accordance with the present invention.

Now referring to FIG. 10, ship 10 is intended to be degaussed utilizing degaussing coil system 20, which includes coils 30 and power supply 40. Coils 30 are appropriately positioned, approximately axially-longitudinally and approximately circumferentially-helically, along the inside periphery of the hull of ship 10. As diagrammatically illustrated, there are seven coils 30, viz., coils $\mathbf{30}_1$, $\mathbf{30}_2$, $\mathbf{30}_3$, $\mathbf{30}_4$, $\mathbf{30}_5$, $\mathbf{30}_6$ and $\mathbf{30}_7$. Each coil 30 receives electrical current originating from power supply 40. Computer 50 is used for implementing an inventive optimal degaussing program, such as described herein, for calibrating degaussing coil system 20 (in particular, coils 30). To some extent, the inventive optimal degaussing program relies on electromagnetic information relating to ship 10 and coils 30, such information being along the lines of that which is shown in FIG. 1 and FIG. 2. The inventive optimal degaussing program generates a solution which gives an optimum current vector i.e., an optimum set of values for coils 30. The current vector which represents the inventive solution has seven current values $c_1$, $c_2$, $c_3$, $c_4$, $c_5$, $c_6$ and $c_7$, which correspond respectively to coils $\mathbf{30}_1$, $\mathbf{30}_2$, $\mathbf{30}_3$, $\mathbf{30}_4$, $\mathbf{30}_5$, $\mathbf{30}_6$ and $\mathbf{30}_7$. This inventively-obtained solution is then implemented for calibrating degaussing coil system 20 whereby a corresponding current amount reaches each coil 30; that is, the amount of current which is caused to electrify each coil 30 is equivalent to the corresponding current value given in the solution.

There are many inventive embodiments in addition to those involving the above-described operator functions. For instance, in accordance with the present invention, there can be alternative combination operator functions and/or alternative mutation operator functions and/or alternative fitness measures. Moreover, combinations of fitness measures can be used. The inventive method is certainly not intended exclusively for application to ship degaussing coil systems, but can be used with any system of coils. The selection operator can select individuals from the population using different criteria than those described hereinabove. Any selection process which tends to choose individuals with better fitness functions can be used. In addition to static coil effects such as used in the description herein, dynamic time-varying coil effects can be used, with driving waveform parameters included in the solution vectors. For example, a solution vector could be vi={ci1, ci2, ci3, ci4, ci5, ci7, fi1, fi2, fi3, fi4, fi5, fi6, fi7}, where fi(j) corresponds to the frequency of the driving waveform for the jth coil.

Therefore, the present invention provides method, apparatus (e.g., a machine having a memory) and a computer program product for calibrating a system of coils for electromagnetic application to an object. The present invention further provides method and apparatus (e.g., system) for effectuating the electromagnetic application to an object. The coil system is of a kind including at least one coil for conducting electrical current and for being proximately disposed in relation to an object. In accordance therewith, at least one optimization parameter is designated, each optimization parameter pertaining to an electromagnetic property of the object. A vector is defined, the vector containing at least one electromagnetic value wherein each coil corresponds to at least one electromagnetic value. A genetic algorithm is executed so as to identify a solution of the electromagnetic vector wherein the application of at least one electromagnetic value to the coil system tends to optimize at least one optimization parameter.

For illustrative purposes, coils 30 are shown in FIG. 10 to be oriented so as to generate a horizontal magnetic field—more specifically, an axial-longitudinal magnetic field. In the light of this disclosure, it is understood by the ordinarily skilled artisan that coils (such as coils 30) can be oriented in any direction or any combination of directions in relation to the object (such as ship 10) being degaussed (or otherwise subjected to some kind of electromagnetic influence). For instance, in FIG. 10, coils 30 can be positioned so as to generate a horizontal magnetic field, and/or a vertical magnetic field, and/or an athwartship (transverse) magnetic field, and/or one or more other directional fields.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A method for calibrating a degaussing system for application to an object having a magnetic field associated therewith, said degaussing system being of the kind including at least one coil for conducting electrical current and for being proximately disposed in relation to said object, said method comprising:

designating at least one optimization parameter pertaining to the magnetic signature of said object in a degaussed condition;

defining a current vector containing at least one current value wherein each said coil corresponds to a said current value; and executing a genetic algorithm so as to identify a solution of said current vector wherein the application of said at least one current value to said degaussing system tends to optimize said at least one optimization parameter;

wherein each said optimization parameter is one of:

linearly derivable from said magnetic signature of said object in a degaussed condition; and nonlinearly derivable from said magnetic signature of said object in a degaussed condition.

2. A method for calibrating as recited in claim 1, wherein at least one said optimization parameter is selected from the group consisting of:

root mean square;

peak;

peak rate-of-change;

peak rate-of-change in a segment of the signature; and distance of the signature from a desired goal signature.

3. A method for calibrating a degaussing system for application to an object having a magnetic field associated therewith, said degaussing system being of the kind including at least one coil for conducting electrical current and for being proximately disposed in relation to said object, said method comprising:

designating at least one optimization parameter pertaining to the magnetic signature of said object in a degaussed condition;

defining a current vector containing at least one current value wherein each said coil corresponds to a said current value; and executing a genetic algorithm so as to identify a solution of said current vector wherein the application of said at least one current value to said degaussing system tends to optimize said at least one optimization parameter;

wherein said executing a genetic algorithm includes:

establishing an initial population of plural said current vectors; and at least once, establishing a succeeding population of plural said current vectors, said succeeding population following the preceding said population, said initial population being said preceding population in relation to the first said succeeding population.

4. A method for calibrating a degaussing system for application to an object having a magnetic field associated therewith, said degaussing system being of the kind including at least one coil for conducting electrical current and for being proximately disposed in relation to said object, said method comprising:

designating at least one optimization parameter pertaining to the magnetic signature of said object in a degaussed condition;

defining a current vector containing at least one current value wherein each said coil corresponds to a said current value; and executing a genetic algorithm so as to identify a solution of said current vector wherein the application of said at least one current value to said degaussing system tends to optimize said at least one optimization parameter;

wherein said establishing a succeeding population includes:

evaluating the fitness of each said current vector in said preceding population, wherein said fitness is based on said at least one optimization parameter; and selecting and combining pairs of said current vectors in said preceding population so as to form new said current vectors for inclusion in said succeeding population, said selecting and combining being repeatedly performed until said succeeding population is numerically complete.

5. The method for calibrating as recited in claim 4, wherein:

said establishing an initial population is performed in a randomized manner;

said selecting is performed in a manner which is randomized and biased toward said fitness wherein each said current vector is characterized by a probability of said selecting which is commensurate with its said fitness;

said combining is performed in a randomized manner; and said initial population and every said succeeding population are equal in number of said current vectors.

6. The method for calibrating as recited in claim 4, wherein said evaluating the fitness of each said current vector in said preceding population includes:

ascertaining the undegaussed magnetic signature of said object;

ascertaining the magnetic effectuation of said at least one coil; and ascertaining the degaussed magnetic signature of said object in terms of said at least one optimization parameter, wherein said ascertaining the degaussed magnetic signature includes:

adjusting said magnetic effectuation in accordance with said current vector; and associating said undegaussed magnetic signature and said adjusted magnetic effectuation.

7. The method for calibrating as recited in claim 6, wherein:

said ascertaining the undegaussed magnetic signature includes at least one of: measuring the undegaussed magnetic signature; and modeling the undegaussed magnetic signature; and said ascertaining the magnetic effectuation includes at least one of: measuring the magnetic effectuation; and modeling the magnetic effectuation.

8. The method for calibrating as recited in claim 4, wherein said establishing a succeeding population includes mutating at least one said current vector in said succeeding population.

9. The method for calibrating as recited in claim 4, wherein said mutating is performed with respect to said succeeding population when said succeeding population is numerically complete, and wherein said mutating is performed in a randomized manner.

10. The method for calibrating as recited in claim 4, wherein said combining includes effecting crossover of at least one said pair of said current vectors in said preceding population so as to form a new said pair of said current vectors for inclusion in said succeeding population.

11. The method for calibrating as recited in claim 3, wherein said executing a genetic algorithm includes:

establishing a last said succeeding population; and determining the best said current vector in said last succeeding population, thereby identifying said solution.

12. A computer program product comprising a computer useable medium having computer program logic recorded thereon for enabling a computer to calibrate a degaussing system for application to an object having a magnetic field associated therewith, said degaussing system being of the type which includes at least one coil for conducting electrical current and for being proximately disposed in relation to said object, said computer program logic comprising:

means for enabling the computer to designate at least one optimization parameter pertaining to the magnetic signature of said object in a degaussed condition;

means for enabling the computer to define a current vector containing at least one current value wherein each said coil corresponds to a said current value; and means for enabling the computer to execute a genetic algorithm so as to identify a solution of said current vector wherein the application of said at least one current value to said degaussing system tends to optimize said at least one optimization parameter;

wherein each said optimization parameter is at least one of:

linearly derivable from said magnetic signature of said object in a degaussed condition;

nonlinearly derivable from said magnetic signature of said object in a degaussed condition; and selected from the group consisting of root mean square, peak, peak rate-of-change, peak rate-of-change in a segment of the signature, and distance of the signature from a desired goal signature.

13. A computer program product comprising a computer useable medium having computer program logic recorded thereon for enabling a computer to calibrate a degaussing system for application to an object having a magnetic field associated therewith, said degaussing system being of the type which includes at least one coil for conducting electrical current and for being proximately disposed in relation to said object, said computer program logic comprising:

means for enabling the computer to designate at least one optimization parameter pertaining to the magnetic signature of said object in a degaussed condition;

means for enabling the computer to define a current vector containing at least one current value wherein each said coil corresponds to a said current value; and means for enabling the computer to execute a genetic algorithm so as to identify a solution of said current vector wherein the application of said at least one current value to said degaussing system tends to optimize said at least one optimization parameter;

wherein said enabling the computer to execute a genetic algorithm includes:

enabling the computer to establish an initial population of plural said current vectors;

enabling the computer to, at least once, establish a succeeding population of plural said current vectors, said succeeding population following the preceding said population, said initial population being said preceding population in relation to the first said succeeding population;

enabling the computer to establish a last said succeeding population; and enabling the computer to determine the best said current vector in said last succeeding population, thereby identifying said solution.

14. The computer program product according to claim 13, wherein said enabling the computer to establish a succeeding population includes:

enabling the computer to evaluate the fitness of each said current vector in said preceding population, wherein said fitness is based on said at least one optimization parameter;

enabling the computer to select and combine pairs of said current vectors in said preceeding population so as to form new said current vectors for inclusion in said succeeding population, said selecting and combining being repeatedly performed until said succeeding population is numerically complete; and enabling the computer to mutate at least one said current vector in said succeeding population.

15. The computer program product according to claim 14, wherein:

said establishing an initial population is performed in a randomized manner;

said selecting is performed in a manner which is randomized and biased toward said fitness wherein each said current vector is characterized by a probability of said selecting which is commensurate with its said fitness;

said combining is performed in a randomized manner;

said mutating is performed with respect to said succeeding population when said succeeding population is numerically complete;

said mutating is performed in a randomized manner; and said initial population and every said succeeding population are equal in number of said current vectors.

16. The computer program product according to claim 14, wherein said enabling the computer to evaluate the fitness of each said current vector in said preceding population includes:

enabling the computer to ascertain the undegaussed magnetic signature of said object;

enabling the computer to ascertain the magnetic effectuation of said at least one coil; and enabling the computer to ascertain the degaussed magnetic signature of said object in terms of said at least one optimization parameter;

wherein said ascertaining the degaussed magnetic signature includes:

adjusting said magnetic effectuation in accordance with said current vector; and associating said undegaussed magnetic signature and said adjusted magnetic effectuation.

17. The computer program product according to claim 14, wherein said combining includes effecting crossover of at least one said pair of said current vectors in said preceeding population so as to form a new said pair of said current vectors for inclusion in said succeeding population.

18. A machine having a memory, said machine containing a data representation of the calibration of a degaussing system for application to an object having a magnetic field associated therewith, said degaussing system being of the type which includes at least one coil for conducting electrical current and for being proximately disposed in relation to said object, said data representation being generated, for availability for containment by said machine, by the method comprising:

designating at least one optimization parameter pertaining to the magnetic signature of said object in a degaussed condition;

defining a current vector containing at least one current value wherein each said coil corresponds to a said current value; and executing a genetic algorithm so as to identify a solution of said current vector wherein the application of said at least one current value to said degaussing system tends to optimize said at least one optimization parameter;

wherein each said optimization parameter is at least one of:

linearly derivable from said magnetic signature of said object in a degaussed condition;

nonlinearly derivable from said magnetic signature of said object in a degaussed condition; and selected from the group consisting of root mean square, peak, peak rate-of-change, peak rate-of-change in a segment of the signature, and distance of the signature from a desired goal signature.

19. A machine having a memory, said machine containing a data representation of the calibration of a degaussing system for application to an object having a magnetic field associated therewith, said degaussing system being of the type which includes at least one coil for conducting electrical current and for being proximately disposed in relation to said object, said data representation being generated, for availability for containment by said machine, by the method comprising:

designating at least one optimization parameter pertaining to the magnetic signature of said object in a degaussed condition;

defining a current vector containing at least one current value wherein each said coil corresponds to a said current value; and executing a genetic algorithm so as to identify a solution of said current vector wherein the application of said at least one current value to said degaussing system tends to optimize said at least one optimization parameter;

wherein said executing a genetic algorithm includes:

establishing an initial population of plural said current vectors;

at least once, establishing a succeeding population of plural said current vectors, said succeeding population following the preceding said population, said initial population being said preceding population in relation to the first said succeeding population;

establishing a last said succeeding population; and determining the best said current vector in said last succeeding population, thereby identifying said solution.

20. The machine having a memory as defined in claim 19, wherein said establishing a succeeding population includes:

evaluating the fitness of each said current vector in said preceding population, wherein said fitness is based on said at least one optimization parameter;

selecting and combining pairs of said current vectors in said preceding population so as to form new said current vectors for inclusion in said succeeding population, said selecting and combining being repeatedly performed until said succeeding population is numerically complete; and mutating at least one said current vector in said succeeding population.

21. The machine having a memory as defined in claim 20, wherein:

said establishing an initial population is performed in a randomized manner;

said selecting is performed in a manner which is randomized and biased toward said fitness wherein each said current vector is characterized by a probability of said selecting which is commensurate with its said fitness;

said combining is performed in a randomized manner;

said mutating is performed with respect to said succeeding population when said succeeding population is numerically complete;

said mutating is performed in a randomized manner; and said initial population and every said succeeding population are equal in number of said current vectors.

22. The machine having a memory as defined in claim 20, wherein said evaluating the fitness of each said current vector in said preceding population includes:

ascertaining the undegaussed magnetic signature of said object;

ascertaining the magnetic effectuation of said at least one coil; and ascertaining the degaussed magnetic signature of said object in terms of said at least one optimization parameter;

wherein said ascertaining the degaussed magnetic signature includes:

adjusting said magnetic effectuation in accordance with said current vector; and associating said undegaussed magnetic signature and said adjusted magnetic effectuation.

23. The machine having a memory as defined in claim 20, wherein said combining includes effecting crossover of at least one said pair of said current vectors in said preceding population so as to form a new said pair of said current vectors for inclusion in said succeeding population.

24. A method for degaussing an object having a magnetic field associated therewith, said method comprising:

proximately disposing at least one coil in relation to said object;

calibrating said at least one coil, said calibrating including: designating at least one optimization parameter pertaining to the magnetic signature of said object in a degaussed condition; defining a current vector containing at least one current value wherein each said coil corresponds to a said current value; and executing a genetic algorithm so as to identify a solution of said current vector wherein the effectuation of said at least one current value tends to optimize said at least one optimization parameter, and causing said at least one coil to conduct electrical current in accordance with said calibrating;

wherein said executing a genetic algorithm includes:

establishing an initial population of plural said current vectors; and at least once, establishing a succeeding population of plural said current vectors, said succeeding population following the preceding said population, said initial population being said preceding population in relation to the first said succeeding population.

25. A system for degaussing an object having a magnetic field associated therewith, said system comprising:

at least one coil for conducting electrical current and for being proximately disposed in relation to said object;

means for calibrating said at least one coil, said calibrating including: designating at least one optimization parameter pertaining to the magnetic signature of said object in a degaussed condition; defining a current vector containing at least one current value wherein each said coil corresponds to a said current value; and executing a genetic algorithm so as to identify a solution of said current vector wherein the effectuation of said at least one current value tends to optimize said at least one optimization parameter; and means for causing said at least one coil to conduct electrical current in accordance with said calibrating;

wherein said executing a genetic algorithm includes:

establishing an initial population of plural said current vectors; and at least once, establishing a succeeding population of plural said current vectors, said succeeding population following the preceding said population, said initial population being said preceding population in relation to the first said succeeding population.

26. A method for calibrating a coil system for electromagnetic application to an object, said coil system being of a kind including at least one coil for conducting electrical current and for being proximately disposed in relation to an object, said method comprising:

designating at least one optimization parameter, each said optimization parameter pertaining to an electromagnetic property of said object;

defining an electromagnetic vector, said electromagnetic vector containing at least one electromagnetic value wherein each said coil corresponds to at least one said electromagnetic value; and executing a genetic algorithm, thereby identifying a solution of said electromagnetic vector wherein the application of said at least one electromagnetic value to said coil system tends to optimize said at least one optimization parameter;

wherein said executing a genetic algorithm includes:

establishing an initial population of plural said electromagnetic vectors; and at least once, establishing a succeeding population of plural said electromagnetic vectors, said succeeding population following the preceding said population, said initial population being said preceding population in relation to the first said succeeding population.

27. The method for degaussing as recited in claim 24, wherein said executing a genetic algorithm includes:

establishing a last said succeeding population; and determining the best said current vector in said last succeeding population, thereby identifying said solution.

28. The system for degaussing as recited in claim 25, wherein said executing a genetic algorithm includes:

establishing a last said succeeding population; and determining the best said current vector in said last succeeding population, thereby identifying said solution.

29. The method for calibrating as recited in claim 26, wherein said executing a genetic algorithm includes:

establishing a last said succeeding population; and determining the best said electromagnetic vector in said last succeeding population, thereby identifying said solution.

* * * * *